US006460365B2

(12) United States Patent
Kim

(10) Patent No.: US 6,460,365 B2
(45) Date of Patent: Oct. 8, 2002

(54) INDOOR UNIT OF A PACKAGE AIR CONDITIONER

(75) Inventor: Jung-suk Kim, Suwon (KR)

(73) Assignee: Mando Climate Control Corporation, Chungcheongnam-do (KR)

( * ) Notice: Subject to any disclaimer, the term of this patent is extended or adjusted under 35 U.S.C. 154(b) by 0 days.

(21) Appl. No.: 09/924,273

(22) Filed: Aug. 7, 2001

(65) Prior Publication Data

US 2002/0104329 A1 Aug. 8, 2002

(30) Foreign Application Priority Data

Sep. 1, 2000 (KR) ..... 00-51655

(51) Int. Cl.[7] ..... F25D 19/00; F24H 3/02
(52) U.S. Cl. ..... 62/298; 454/234; 165/54
(58) Field of Search ..... 62/298, 408, 410, 62/412, 427, 89; 312/236; 165/54; 454/234, 261, 263, 275

(56) References Cited

U.S. PATENT DOCUMENTS 4,828,019 A * 5/1989 Ishizuka et al. ..... 165/54
5,542,469 A * 8/1996 Kim ..... 165/54 X
6,059,654 A 5/2000 Kim
6,066,041 A 5/2000 Hernandez et al.

FOREIGN PATENT DOCUMENTS

JP 2001324205 A * 11/2001

* cited by examiner

*Primary Examiner*—Chen-Wen Jiang
(74) *Attorney, Agent, or Firm*—John P. White; Cooper & Dunham LLP

(57) ABSTRACT

The present invention provides an indoor unit of a package air conditioner sustaining a high air cooling efficiency and improved exterior appearance by constituting the front lower panel of indoor unit with a plate and a frame and making the imbibed indoor air dispersed evenly over the entire heat exchanger through a first air inlet port provided between the plate and the frame and second air inlet ports on the side of the frame. The front lower panel 11 of the indoor unit 10 according to the present invention is consisted of a frame 11*a* installed on the front lower portion of the main body and of a plate 11*b* placed with an inclination of the predetermined angle for the frame 11*a* and has a first air inlet port 12 and second air inlet ports 12' through which the indoor air is flown, wherein the first air inlet port 12 is formed between the plate 11*b* and the frame 11*a* and the second air inlet ports 12' is formed on the side portion of the frame 11*a*.

5 Claims, 4 Drawing Sheets

INDOOR UNIT OF A PACKAGE AIR CONDITIONER

BACKGROUND OF THE INVENTION (1) Field of the Invention

The present invention relates to an indoor unit of a package air conditioner, and more specifically to an indoor unit of a package air conditioner having a high air cooling efficiency and improved exterior appearance by constituting the front lower panel of indoor unit with plate and frame and making the imbibed indoor air dispersed evenly over the entire heat exchanger through a first air inlet port provided between the plate and the frame and a second air inlet ports provided on the side of the frame.

(2) Description of the Prior Art

In general, the air conditioner properly maintains the temperature of indoor spaces such as the office, living room, or the inside of a building, for activity by supplying the cool air into the airtight indoor space, having the air conditioning as the basic function.

This air conditioner is consisted of the indoor unit and an outdoor unit, in the case of being composed of one body is called the one body type air conditioner, and the other case of being composed separately is called the separate type air conditioner. A typical example of the former case would be the window type air conditioner, and the latter case would be the package type air conditioner. This invention explains the package air conditioner used most recently among the air conditioners classified as above.

The package air conditioner consists of an indoor and outdoor unit, and as of the former indoor unit, a heat exchanger is installed so that the indoor air imbibed by the blower is cooled in passing through the heat exchanger and is discharged again into the indoor space making the indoor air conditioning. In the latter outdoor unit, a compressor and a condenser is installed, the compressor plays the role of compressing the refrigerant flown from the heat exchanger of indoor unit, and the condenser plays the role of condensing the refrigerant flown from the compressor through the heat exchange with the environmental air imbibed by fan and plays the role of sending this to the heat exchanger of the indoor unit.

FIG. 1 shows the indoor unit 1 of the package air conditioner by the prior art.

With reference to the FIG. 1, the heat exchanger is installed in the indoor unit 1, so with the process of refrigerant flown from the condenser of the outdoor unit (not shown) passing through the heat exchanger, the indoor air imbibed by the blower is cooled frosty in the process of passing through the heat exchanger, and is supplied indoors to make air cooling.

The refrigerant heat-exchanged with the indoor air with passing through the heat exchanger is supplied to the compressor of the outdoor unit again, compressed, and then supplied to the condenser of the outdoor unit.

On the front lower panel 1*a* placed on the front lower portion of the indoor unit 1, a plurality of air inlet ports 2 to imbibe the indoor air is provided, and the upper portion of the indoor unit 1 is provided with an outlet vent 3 to discharge the cooled air through the indoor heat exchanger indoors again. On the outlet vent 3 of the indoor unit 1, a plurality of blades 5 is installed to change the wind direction of the air discharged indoors. In general, these blades 5 have a structure possible of alternating motion vertically and side ways to change the wind direction. Approximately in the middle part of the indoor unit, the control panel 4 is provided to control the entire operating condition or to set up the air-cooling temperature.

In the case of the indoor unit 1 of the conventional package air conditioner with this type of structure, the external appearance remains unattractive because a large number of the air inlet port 2 is formed on the front side of the front lower panel to imbibe the indoor air. In addition, not only is the air-cooling efficiency deteriorated because of the imbibed indoor air which is concentrically flown into the center of the heat exchanger, in consequence to the center concentration of the hot air, there is a problem of the heat exchanger being short life-spanned. Also, because the part of the air inlet port 2 is installed in the shape of a grille, there is a disadvantage that it can be easily broken since the form of the structure is very fragile.

SUMMARY OF THE INVENTION

As a concoction created in order to resolve such problems, its goal is to provide an indoor unit of the package air conditioner that has an elevated external appearance by altering the inlet port position of the front lower panel of the indoor unit and allowing the indoor air flown in through the inlet port be evenly dispersed over the entire heat exchanger and improve the air-cooling efficiency.

Another object of this invention is to provide an indoor unit of the package conditioner that prevents damage by heightening the strength of the front lower panel, and at the same time, improve the flowing path of the imbibed air by changing the form of the front lower panel shaped as a grille to the form of a plate.

In accordance with this present invention, an indoor unit of the package air conditioner comprising a main body installed with the heat exchanger through which the refrigerant is flown from the condenser of an outdoor unit and a blower, a front lower panel placed on the front lower portion of the main body, an outlet vent formed on the upper part of the main body to discharge the cooled air indoors passing through the heat exchanger after flown in through the front lower panel by the operation of the blower, and a control panel to control the air-cooling temperature and the entire operating condition of the air conditioner; characterized in that the front lower panel is consisted of a frame installed on the front lower portion of the main body and of a plate placed with an inclination of the predetermined angle for the frame and has a first air inlet port and second air inlet ports through which the indoor air is flown, wherein the first air inlet port is formed between the plate and the frame and the second air inlet ports is formed on the side portion of the frame.

BRIEF DESCRIPTION OF DRAWINGS

Other objects and aspects of the present invention will become apparent from the following description of embodiments with reference to the accompanying drawing in which.

DESCRIPTION OF THE PREFERRED EMBODIMENTS

Figure 2:
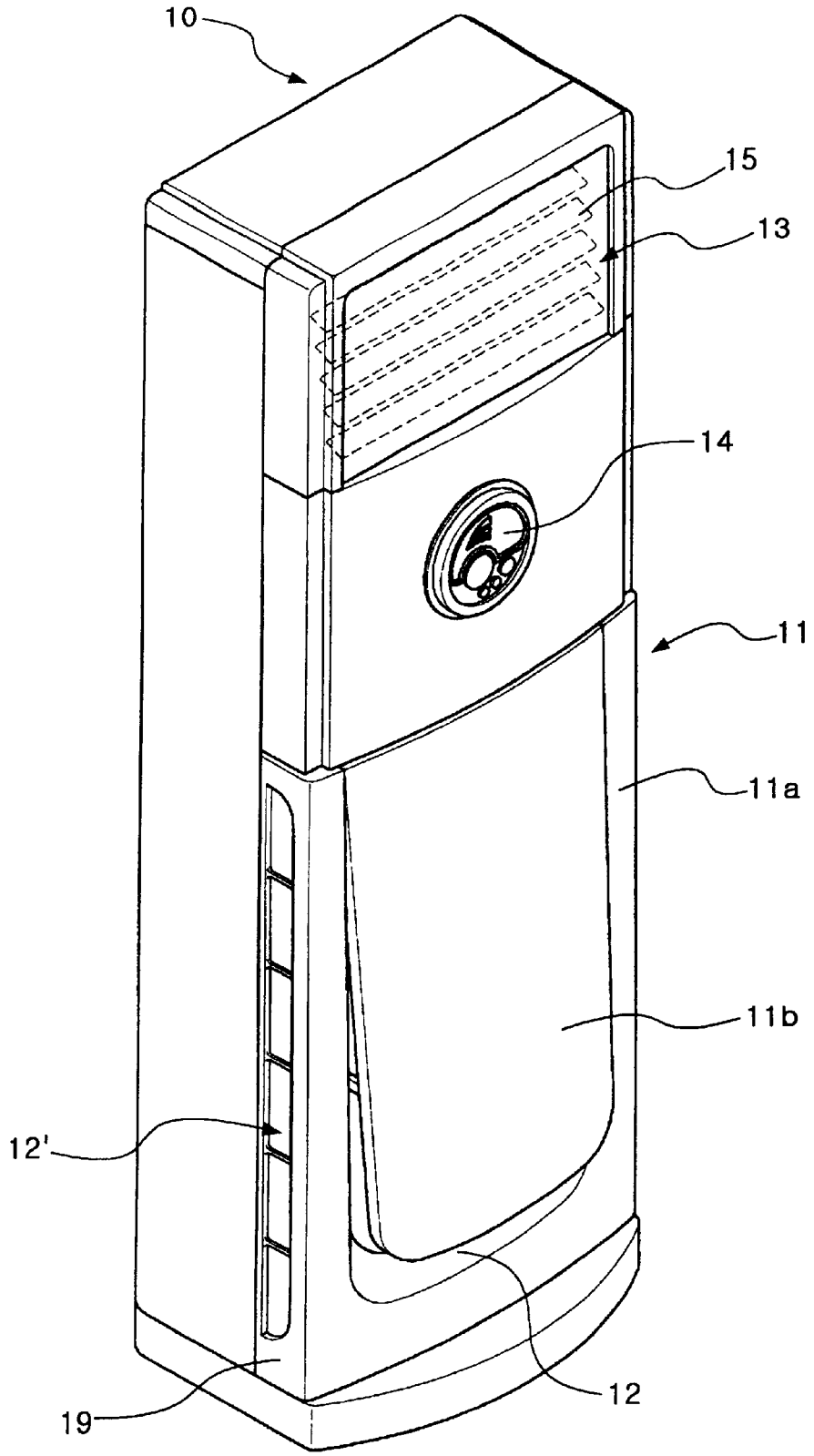
FIG. 2 is a front side perspective view showing an indoor unit of the package air conditioner in accordance with this invention.

Firstly, as shown on the FIG. 2, the front lower panel 11 of the indoor unit 10 according to the present invention is consisted of two parts, such as a frame 11*a* and a plate 11*b*, and by these frame 11*a* and plate 11*b*, the front lower panel 11 of the indoor unit 10 according to the present invention are provided with two air inlet port 12 and 12'. In these ports, the first air inlet port 12 is provided by the space part between the frame 11*a* and the plate 11*b*, and the second air inlet ports 12' is provided on the side part 19 of the frame 11*a*.

Wherein, the lower portion of the plate 11*b* is placed inclined in slightly protruded condition to provide the first air inlet port 12 on the interval with the frame 11*a*.

Figure 1:
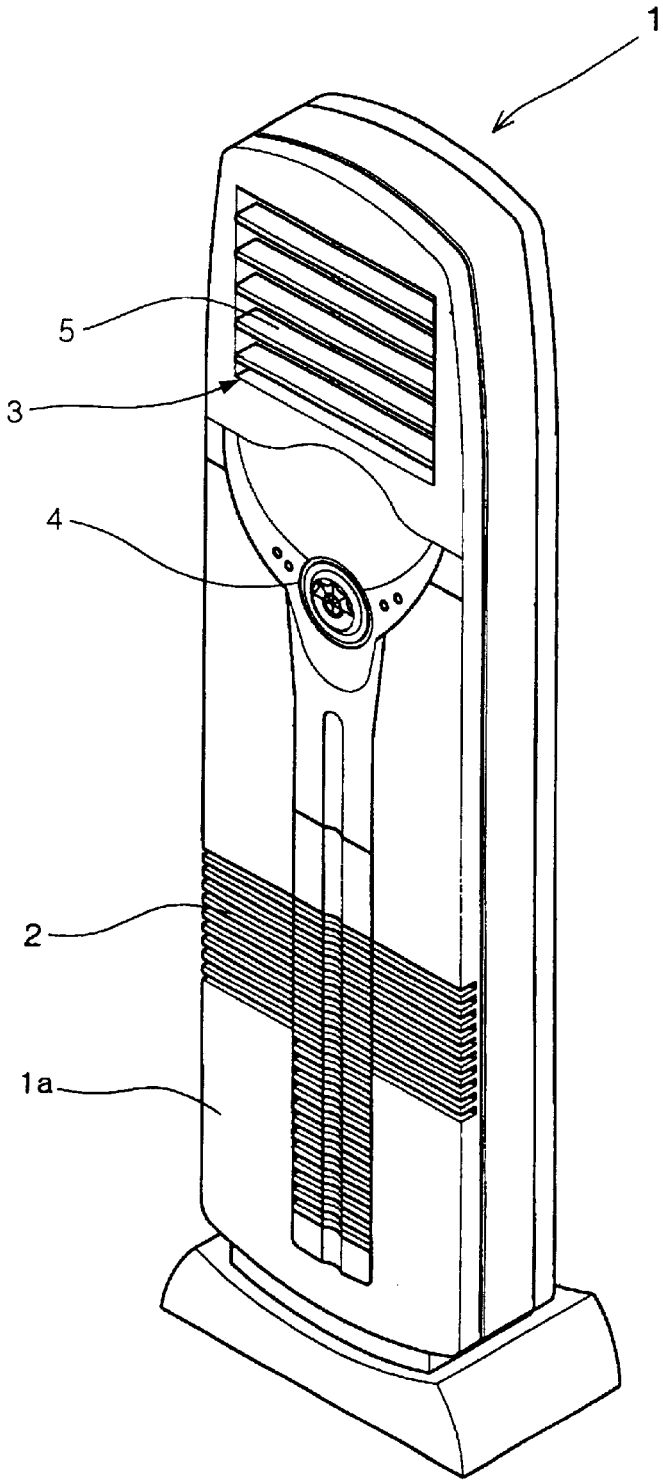
FIG.1 (PRIOR ART)
FIG. 1 is a perspective view showing an indoor unit of the package air conditioner by the prior art.

Like this, in the preferable embodiment of this invention the plate 11*b* is provided on the front lower panel 11 to provide the first air inlet port 12, so this adds to the beauty compared with the front lower panel (1*a* of FIG. 1) with the form of a grille constituting the conventional indoor unit, increasing the entire strength. The first air inlet port 12 provided by the plate 11*b* is formed over the space part of the three sides such as the base, both sides, and the frame 11*a*. Accordingly, the indoor air is supplied evenly to the heat exchanger through the first air inlet port 12 formed on these three sides, so the heat exchanging efficiency is increased and the entire cooling function of the air conditioner is improved, compared with the one of the conventional type.

Meanwhile, as above mentioned about the side part 19 of the front lower panel 11, a plurality of the second air inlet ports 12' is provided, supplying the indoor air to the heat exchanger through the second air inlet ports 12' in addition to the first air inlet port 12. Consequently, compared with the structure of the conventional indoor unit supplying the indoor air from the front side of the front lower panel, the indoor unit structure of this invention is possible of supplying the indoor air over three sides such as the front side portion and both side portions, and of dispersing the indoor air more evenly.

On the middle part and the upper part of the indoor unit 10, the control panel 14 and the outlet vent 13 are each installed, and on the outlet vent 13 a plurality of blades 15 is installed for the flexibility to move vertically and horizontally to modulate the wind direction though not shown in detail.

Figure 3:
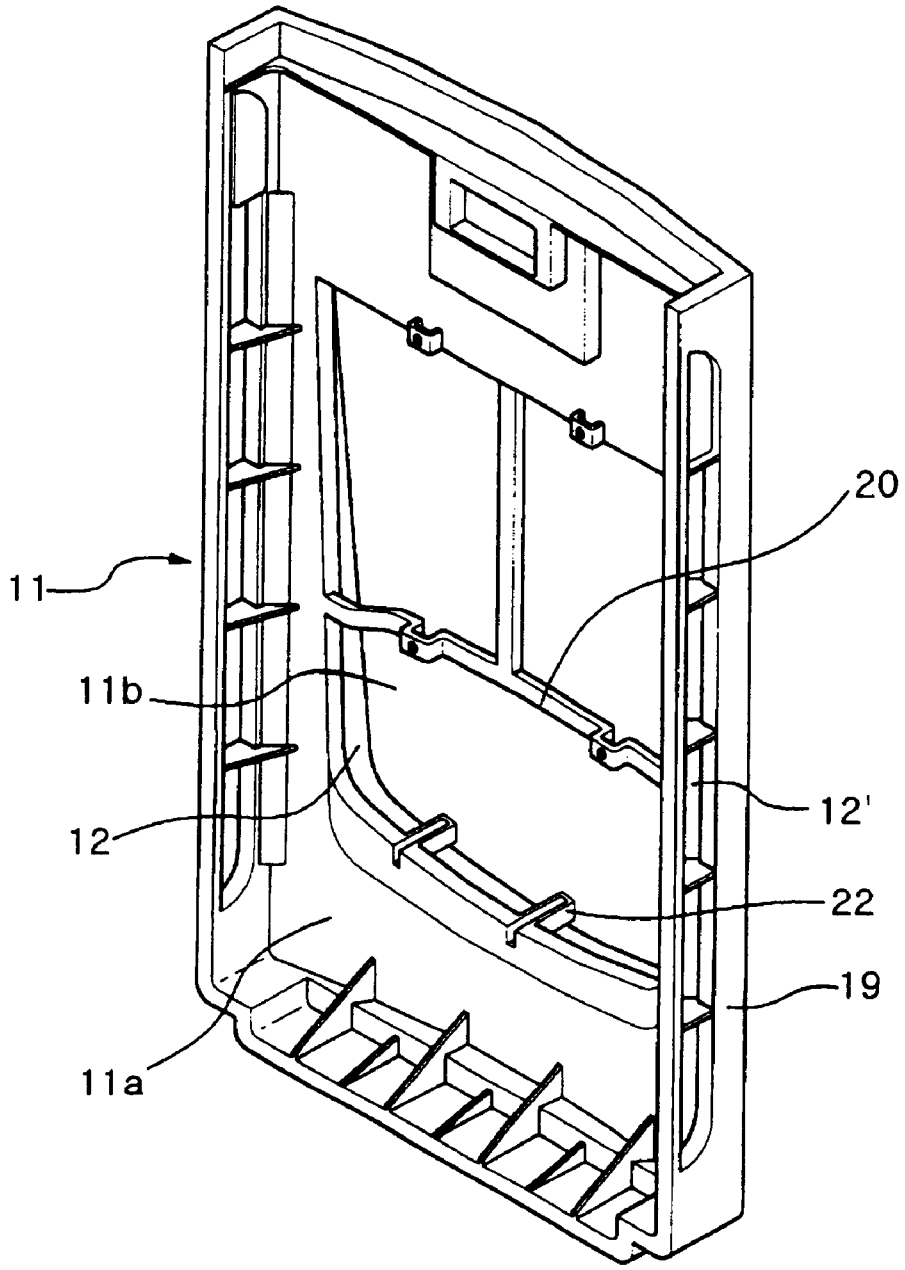
FIG. 3 is a rear side perspective view showing a front lower panel of the indoor unit in accordance with this invention.

And then, in the FIG. 3 the front lower panel 11 structure of the indoor unit adopted from this invention is shown. As shown in the drawings, the front lower panel 11 according to this invention is provided with the plate 11*b* to furnish the first air inlet port 12. Also, on the frame 11*a* of the front lower panel 11, the rib 20 is installed vertically and horizontally, for increasing the strength in addition to maintaining the slanted condition of the plate 11*b*. This rib 20 has the central part with slightly and forwardly protruded form for the plate 11*b* to maintain the slanted condition with predetermined angle. The lower portion of the plate 11*b* is supported by a plurality of protuberances 22 prolonged forwardly to furnish the first air inlet port 12 between the lower portion of the plate 11*b* and the frame 11*a*.

Figure 4:
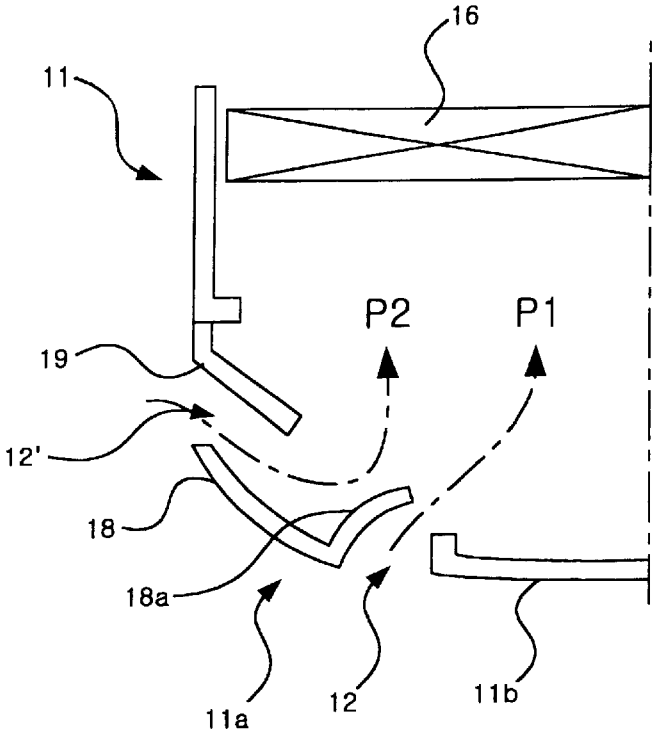
FIG. 4 is a sectional view showing an air guide installed on the front lower panel in accordance with this invention.
Figure 5:
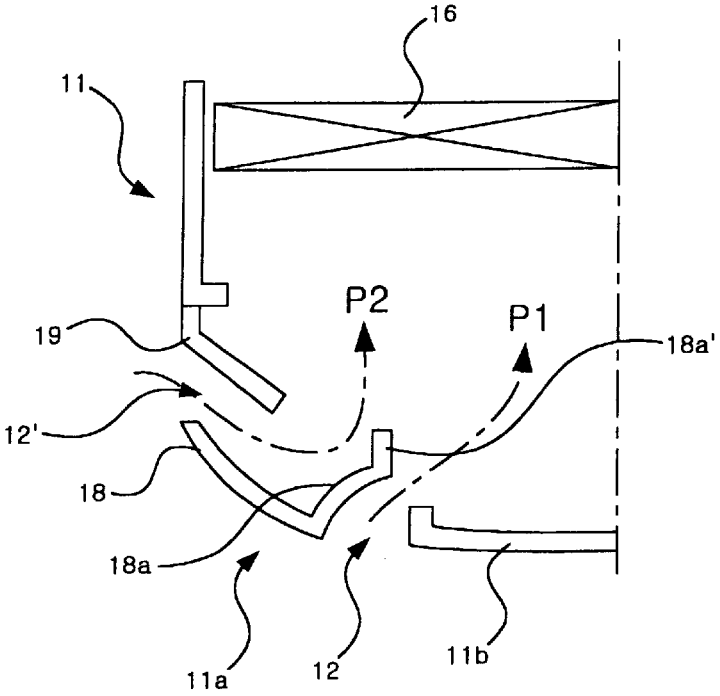
FIG. 5 is a sectional view showing an air guide installed on the front lower panel in accordance with another embodiment of this invention.

Next, as shown in the FIG. 4, the air guide part 18*a* is formed by inwardly bending a part of the frame 11*a* corner part 18. When the blower installed inside the indoor unit 10 is operated, the indoor air is flown through the first air inlet port 12 provided between the side part, lower portion of the plate 11*b* and the corner part 18 of the frame 11*a* following the arrow direction P1, and some air is flown through the plurality of the second air inlet ports 12' formed between the corner part 18 of the frame 11*a* and the side part 19 of the frame 11*a* following the arrow direction P2. At this time, by the air guide part 18*a* formed on the corner part 18 of the frame 11*a*, the air flown through the first air inlet port 12 and the second air inlet ports 12' is leaded to be dispersed evenly over the entire sides of the heat exchanger 16. Meanwhile, as shown in the FIG. 5, the prolonged portion 18*a*' is formed on the edge part of the air guide part 18*a* for the air flown through the first air inlet port 12 and the second air inlet ports 12' to be dispersed to the heat exchanger 16 more widely. Owing to this, the air flown through the first air inlet port 12 provided between the corner part 18 of the frame 11*a* and the plate 11*b* following the arrow direction P1 and the air flown through the second air inlet ports 12' formed between the corner part 18 of the frame 11*a* and the side part 19 of the frame 11*a* following the arrow direction P2 are leaded to be dispersed more evenly over the entire sides of the heat exchanger 16 by the prolonged 18*a*' of the air guide 18*a* formed on the frame 11*a*.

The function of the indoor unit constituted as such according to this invention is explained.

For the indoor air-cooling, when the switch on the control panel 4 installed on the front of the indoor unit 10 is operated, the blower begins to function according to the operating signal of the switch. According to the function of the blower, the hot indoor air imbibed is evenly dispersed to the heat exchanger 16 installed inside the indoor unit 10 through the first and the second inlet port 12 and 12' formed on the front lower panel 11.

In this process, the air flown into the first air inlet port 12 by the air guide 18*a* formed on the corner part 18 of the frame 11*a* is dispersed evenly to the heat exchanger 16. Especially, in the structure provided with the prolonged portion 18*a*', the air flown into the heat exchanger 16 is dispersed and supplied more evenly.

In the process that the air is evenly dispersed and flown as such, passing through the heat exchanger 16, the air is heat-exchanged with the refrigerant flowing inside the heat exchanger 16 and cooled frosty, and the cooled air is supplied indoors through the outlet vent 13 formed on the upper part of the indoor unit 10 with indoor air-cooling.

As explained above, in the indoor unit of the package air conditioner by this invention, the indoor air imbibed by the first and the second air inlet ports provided by the frame and the plate is dispersed evenly to the heat exchanger with increased heat exchanging efficiency and improved air-cooling function of the air conditioner. Also, the plate is supported by the rib installed horizontally with the benefit of entirely improved strength.

What is claimed is:

1. An indoor unit of the package air conditioner comprising a main body installed with the heat exchanger through which the refrigerant is flown from the condenser of an outdoor unit and a blower, a front lower panel placed on the front lower portion of the main body, an outlet vent formed on the upper part of the main body to discharge the cooled air indoors passing through the heat exchanger after flown through the front lower panel by the operation of the blower, and a control panel to control the air-cooling temperature and the entire operating condition of the air conditioner; characterized in that the front lower panel is consisted of a frame installed on the front lower portion of the main body and of a plate placed with an inclination of the predetermined angle for the frame and has a first air inlet port and second air inlet ports through which the indoor air is flown, wherein the first air inlet port is formed between the plate and the frame and the second air inlet ports is formed on the side portion of the frame.

2. The indoor unit of claim 1, characterized in that the corner of the frame has an air guide to conduct the indoor air flown through the first air inlet port and the second air inlet ports evenly dispersed to the heat exchanger.

3. The indoor unit of claim 2, characterized in that the edge part of the corner air guide has a prolonged portion to conduct the indoor air flown through the second air inlet ports evenly dispersed to the heat exchanger.

4. The indoor unit of claim 1, characterized in that the frame has a rib, which is placed horizontally and vertically on the frame supporting the plate.

5. The indoor unit of claim 1, characterized in that the frame has a plurality of protuberance pressing the lower portion of the plate.

* * * * *